US008215061B2

(12) United States Patent
Gosling et al.

(10) Patent No.: US 8,215,061 B2
(45) Date of Patent: Jul. 10, 2012

(54) SLIDING DOOR APPARATUS HAVING A DAMPING MECHANISM

(75) Inventors: Geoff Gosling, Calgary (CA); Mogens Smed, Dewinton (CA)

(73) Assignee: Dirtt environmental solutions Ltd., Calgary, AB (CA)

( * ) Notice: Subject to any disclaimer, the term of this patent is extended or adjusted under 35 U.S.C. 154(b) by 1007 days.

(21) Appl. No.: 11/344,600

(22) Filed: Feb. 1, 2006

(65) Prior Publication Data

US 2006/0185250 A1 Aug. 24, 2006

Related U.S. Application Data

(60) Provisional application No. 60/648,435, filed on Feb. 1, 2005.

(51) Int. Cl.
*E05F 11/54* (2006.01)

(52) U.S. Cl. ..... 49/409; 49/410; 49/138; 49/137

(58) Field of Classification Search ..... 49/409, 49/323, 410, 138, 137; 16/66, 51, 56, 57, 16/58, 84, 82, 83
See application file for complete search history.

(56) References Cited

U.S. PATENT DOCUMENTS

| | | | | | |
|---|---|---|---|---|---|
| 552,006 | A | * | 12/1895 | Runkel | 16/84 |
| 1,013,762 | A | | 1/1912 | Hoffman | |
| 1,017,757 | A | | 2/1912 | Gibbs | |
| 1,263,108 | A | * | 4/1918 | Randall | 91/43 |
| 1,578,678 | A | * | 3/1926 | Norton | 303/6.01 |
| 1,744,069 | A | * | 1/1930 | Dapron | 91/23 |
| 2,027,423 | A | * | 1/1936 | Gardiner | 16/84 |
| 2,083,762 | A | * | 6/1937 | Waldman | 16/84 |
| 2,207,322 | A | | 2/1939 | Long | |
| 2,209,733 | A | | 10/1939 | Jones | |
| 2,523,935 | A | | 11/1946 | Austin | |
| 2,791,793 | A | * | 5/1957 | Fenton | 16/82 |
| 3,083,399 | A | * | 4/1963 | Moran et al. | 16/66 |
| 3,327,428 | A | * | 6/1967 | Horton et al. | 49/177 |
| 3,921,335 | A | * | 11/1975 | Hewitt et al. | 49/265 |
| 3,938,282 | A | * | 2/1976 | Goyal | 49/137 |
| 4,067,144 | A | * | 1/1978 | Ogishi | 49/360 |
| 4,290,368 | A | * | 9/1981 | Mazzini | 105/341 |
| 4,611,436 | A | | 9/1986 | Williams | |
| 4,657,318 | A | | 4/1987 | Strange | |
| 4,680,828 | A | | 7/1987 | Cook | |
| 4,999,873 | A | | 3/1991 | Lisak | |
| 5,115,596 | A | | 5/1992 | Fevold | |
| 6,145,630 | A | * | 11/2000 | Friedman et al. | 187/313 |
| 6,148,451 | A | * | 11/2000 | DeBraal et al. | 4/607 |
| 6,557,303 | B2 | * | 5/2003 | Finke et al. | 49/409 |
| 6,938,372 | B2 | * | 9/2005 | Kennedy et al. | 49/138 |
| 7,013,605 | B2 | * | 3/2006 | Zhou et al. | 52/30 |
| 7,118,472 | B2 | * | 10/2006 | Kennedy et al. | 454/169 |
| 7,124,469 | B2 | * | 10/2006 | Tsekhanovsky et al. | 16/79 |
| 7,228,659 | B2 | * | 6/2007 | Romero et al. | 49/409 |
| 2002/0069588 | A1 | * | 6/2002 | Finke et al. | 49/409 |

* cited by examiner

*Primary Examiner* — Gregory J. Strimbu
(74) *Attorney, Agent, or Firm* — Welsh Flaxman & Gitler LLC

(57) ABSTRACT

A sliding door apparatus for opening and closing an opening in a wall. A sliding door apparatus including a longitudinally extending track member mountable along an upper edge of an opening and a door movably mountable on the track member for sliding movement thereon between opened and closed positions. A damping structure is disposed within the track member and is actuatable in response to the sliding movement of the door to break the door's movement as it approaches its opened and closed positions.

15 Claims, 7 Drawing Sheets

FIGURE 10
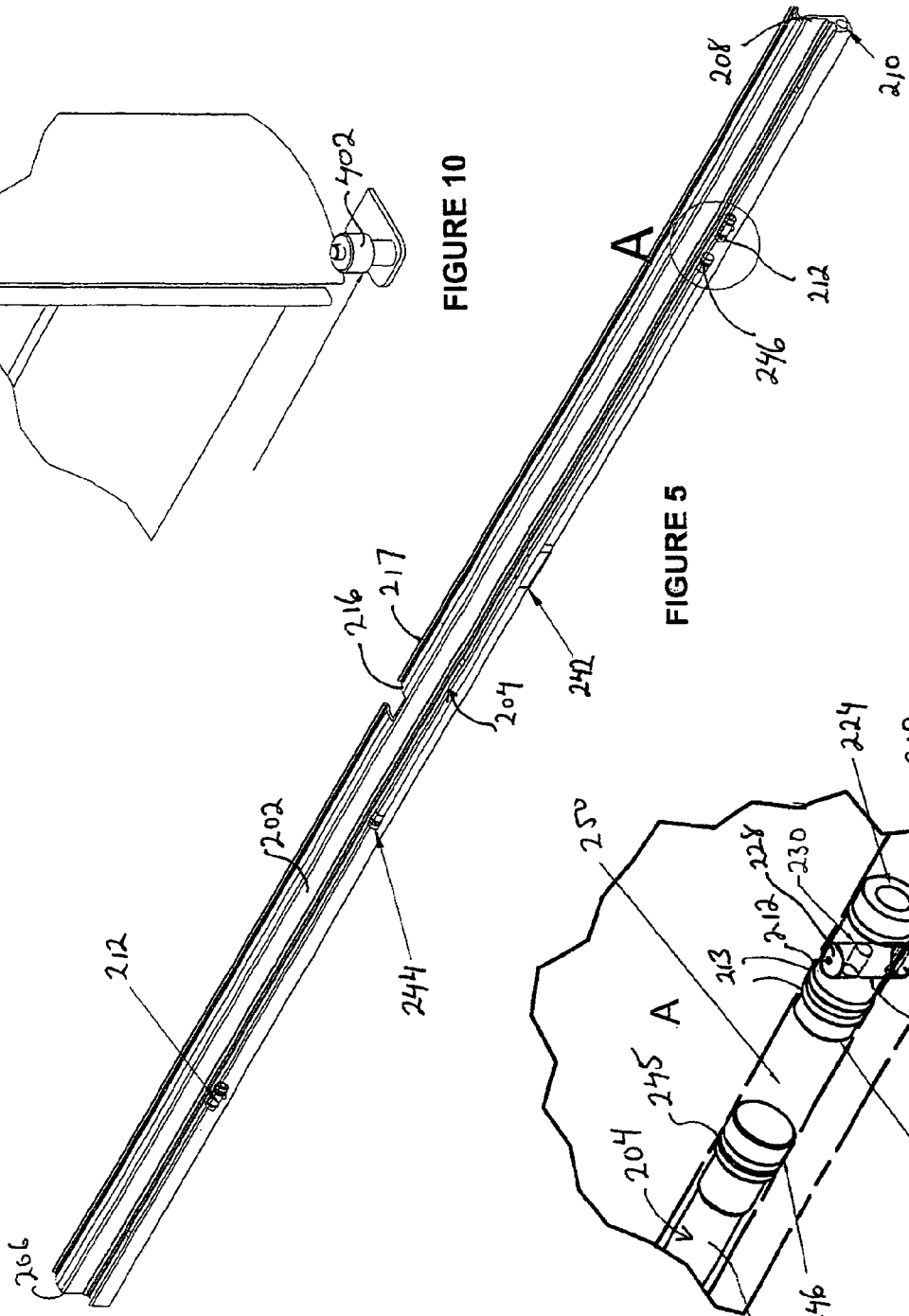
FIGURE 5
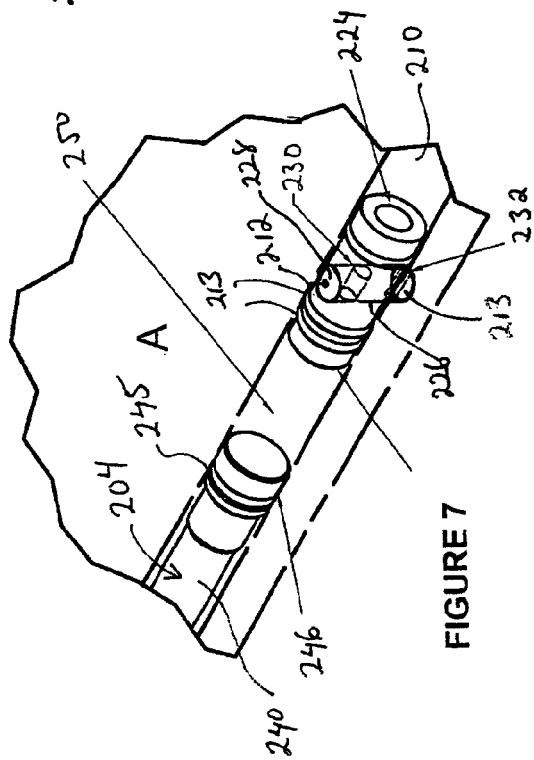
FIGURE 7

SLIDING DOOR APPARATUS HAVING A DAMPING MECHANISM

CROSS-REFERENCE TO RELATED APPLICATIONS

The subject patent application claims priority to U.S. Provisional Application Serial No. 60/648,435 which was filed on Feb. 1, 2005, the entirety of which is incorporated herein by reference.

FIELD OF THE INVENTION

The present invention relates generally to sliding door assemblies.

BACKGROUND OF THE INVENTION

The present invention relates to a sliding door assembly for closing an opening in a wall, wherein the sliding door is provided with rollers mounted on its upper edge for movement in a plane parallel to and spaced from the wall. The rollers are supported by and roll along a support track which is secured to the wall.

Sliding door assemblies in the art comparable to the present invention have complicated designs and complicated installation procedures requiring the assembly of several different components. Two aspects of these sliding door assemblies in particular complicate their design and installation procedures. First, sliding door assemblies in the art have means of slowing the motion of a sliding door at both ends of the sliding door's support track. Second, sliding door assemblies in the art employ discrete fastening means to secure the sliding door assemblies to a wall.

In light of the above drawbacks with conventional sliding doors, it is apparent that there is a need for a sliding door apparatus with a simplified design and installation procedure.

SUMMARY OF THE INVENTION

The present invention is directed toward providing an improved apparatus for a sliding door assembly. One objective of the present invention is to provide a sliding door assembly with an integrated slowdown mechanism. Another objective of the present invention is to provide a sliding door assembly with a simplified design. Yet another object of the present invention to provide a sliding door assembly that can be installed quickly and easily.

One or more of the stated objectives is accomplished by a sliding door assembly which utilizes a single catch or stop block, located at the approximate center point of the sliding door's support track, to slow the motion of the sliding door in either direction along the support track. The use of a single catch reduces the number of discrete parts that must be assembled during installation. The single catch also simplifies the design and construction of the sliding door assembly. Further, the single catch design allows the sliding door to travel the full length of the support track because there is no need for a braking mechanism between the sliding door and end of the support track. Further still, sliding doors assemblies can be mounted next to one another and the doors of the respective assemblies can meet without a gap.

One or more of the stated objectives is accomplished by a sliding door assembly which utilizes a mounting arm that attaches the sliding door assembly to an existing wall structure without the use of additional fasteners. The mounting arm simplifies the design and construction of the sliding door assembly, as well as the installation procedure.

According to the present invention then, there is provided a sliding door apparatus for opening and closing an opening in a wall, comprising a longitudinally extending track member mountable along an upper edge of said opening; a door movably mountable on said track member for side to side movement thereon between an opened and closed position; and damping means disposed within said track member actuatable in response to said side to side movement of said door to break said door's movement as it approaches its fully opened and closed positions.

According to another aspect of the present invention then, there is also provided apparatus for absorbing the energy of a moving object, said apparatus comprising a housing having a piston chamber formed therein; a piston disposed in said chamber for axial movement therein; a plug member held in said piston chamber in opposed relation to said piston, said plug member creating a fully or partially air-tight seal with said piston chamber; means interconnecting said piston to said moving object, wherein movement of said object that moves said piston towards said plug member compresses air between said piston and said plug member to absorb the moving object's energy.

According to another aspect of the present invention then, there is also provided apparatus for suspending a sliding door for opening and closing an opening in a wall, said apparatus comprising a stringer member for connection along an upper edge of said opening, said stringer member having an axially aligned channel therein formed along at least a portion of said stringer's length; a track member having a longitudinally extending flange member thereon adapted to engage said channel in said stringer to connect said track member to said stringer member without the use of fasteners; and a door adapted to be suspended from said track member for side to side movement of said door relative to said track member.

According to another aspect of the present invention then, there is also provided a method for suspending a sliding door for opening and closing and opening in a wall, said method comprising the steps of connecting a stringer member to an upper edge of said opening, said stringer member having a channel extending longitudinally therein along at least portions of said stringer member's length; connecting a track member to said stringer member without the use of fasteners, said connecting step comprising inserting a flange member on said track member into said channel to secure said track member to said stringer member; and suspending said sliding door from said track member by aligning rollers on said door in a roller channel in said track member so that said door can move from side to side relative to said track member.

BRIEF DESCRIPTION OF THE DRAWINGS

Preferred embodiments of the present invention will now be described in greater detail and will be better understood when read in conjunction with the following drawings in which:

FIG. 5 is a perspective, partially transparent view of the assembled support track assembly of FIG. 3;

FIG. 7 is an enlarged, perspective, partially sectional and transparent view of a portion of the piston channel in the support track assembly if FIG. 3;

FIG. 10 is a perspective view of a guide roller forming part of the present door assembly;

DETAILED DESCRIPTION OF THE PREFERRED EMBODIMENT

Figure 1:
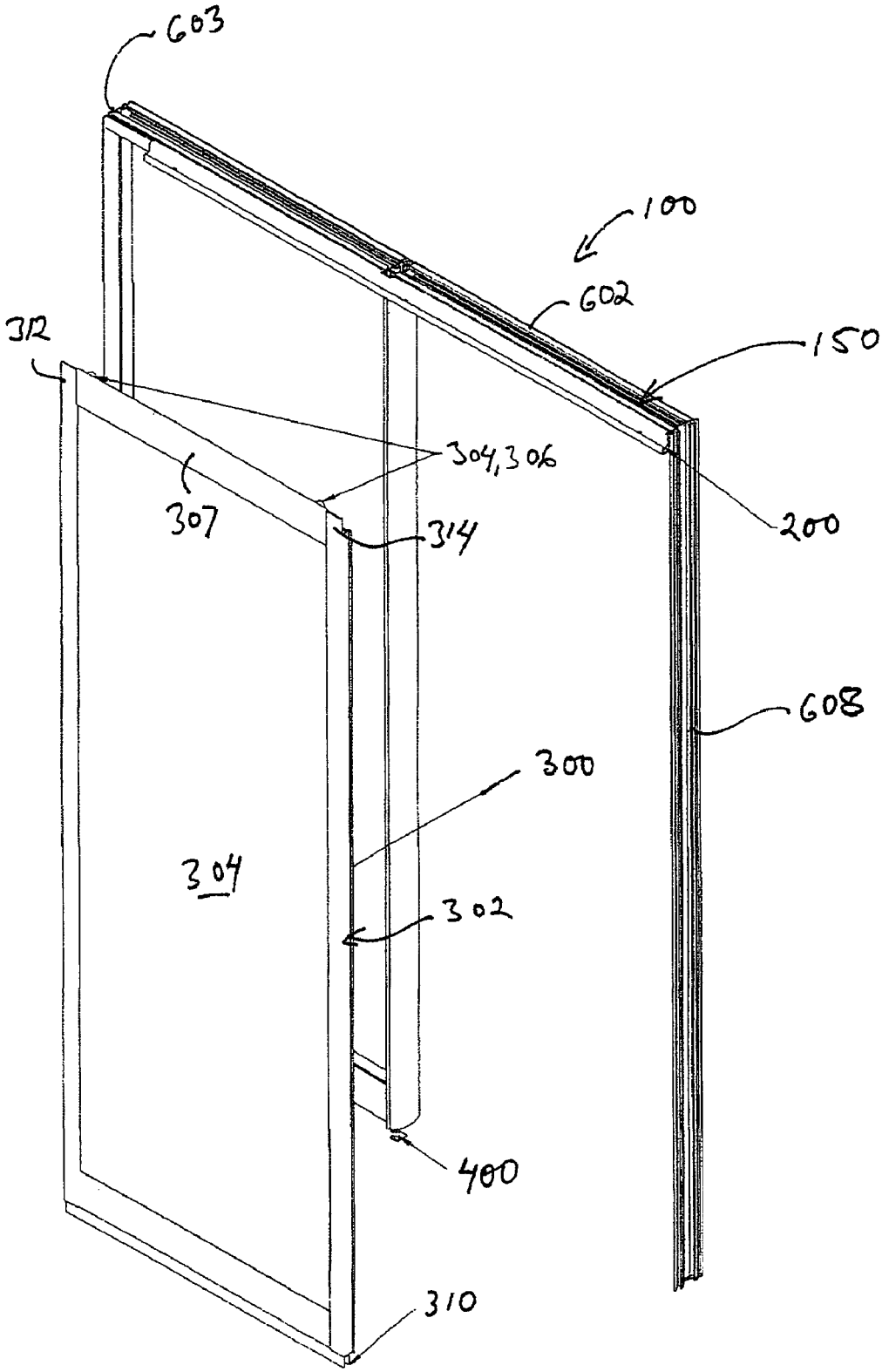
FIG. 1 is a perspective view of the sliding door assembly according to an embodiment of the invention.

With reference to FIG. 1, the sliding door assembly 100 of the present invention generally comprises a sliding door 300, a sliding door frame 150 consisting of an upper horizontal stringer 602 and spaced apart vertical stringers 608 and a support track assembly 200 that releasably connects to frame 150 and which also supports door 300 for back and forth movement while providing progressive damping or braking as the door approaches its fully opened and closed positions and a floor assembly 400.

Figure 2:
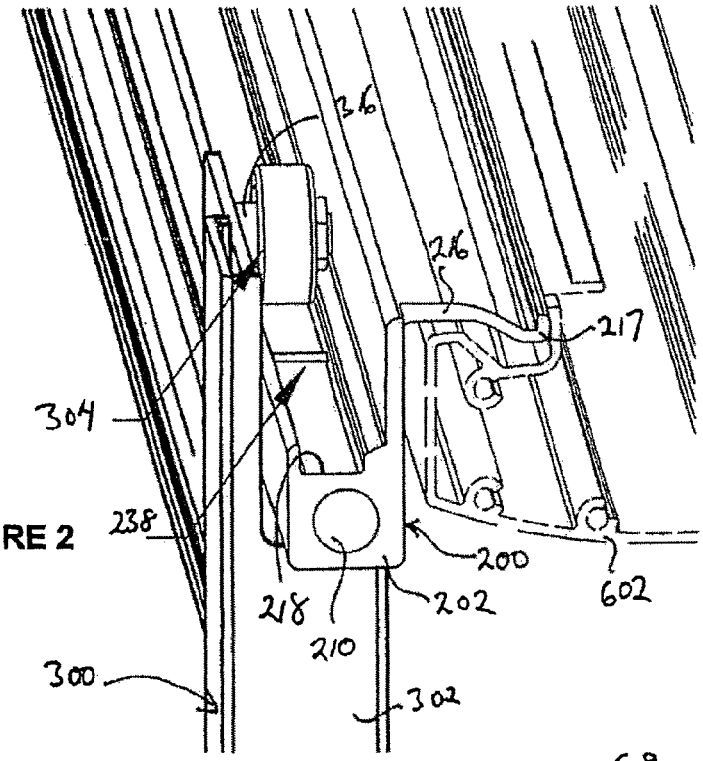
FIG. 2 is a perspective view of a portion of the sliding door assembly of FIG. 1.

FIG. 2 provides a more detailed view of the connection between door 300, support track assembly 200 and stringer 602 of frame 150. Support track assembly 200 "hooks" into stringer 602 for a cantilevered connection as will be described more fully below. Door 300 is then suspended from support track assembly 200 by means of rollers 304, 306 that are received into a roller channel 218 in assembly 200. The rollers are free to roll from side to side in channel 218 for opening and closing movements of door 300.

The heart of the present assembly is support track assembly 200 which incorporates damping means used to brake or slow the door's motion as it approaches its fully opened and closed positions that will now be described in greater detail with reference to FIGS. 2 to 6.

The core of support track assembly 200 is an elongated support track extrusion 202 which will typically be fabricated from aluminum or some other preferably light and strong metal.

Support track extrusion 202 comprises a first end 206, a second end 208, a cylindrical piston channel 210 formed longitudinally therethrough, a rearwardly extending mounting arm 216 that hooks onto horizontal stringer 602 and a roller channel 218 that extends from end 206 to end 208.

The integrated cylindrical piston channel 210 extends from the first end 206 of the support track extrusion to the second end 208 and is shaped to slidingly receive a piston 204 therein. As will be seen most clearly in FIGS. 3 and 4, midway along the length of piston channel 210, a section of the bottom of extrusion 202 is cut away to form a cut-out 220 that extends vertically from the bottom of the piston channel to the bottom surface of extrusion 202 itself.

As will be described below, the side-to-side width of cut-out 220 will vary depending upon the distance the sliding door travels from its fully opened to fully closed positions. Cut-out 220 provides clearance for the movement of an actuating member that transmits movement of the door to the piston. In one embodiment contemplated by the applicant, the actuating member is a stop block 242 that is connected to the mid-point of piston 204 and which moves piston 204 back and forth in channel 210 in response to the door's side-to-side opening and closing movements.

With reference to FIG. 5, there is located within piston channel 210 a pair of channel plugs 212, located at opposite ends of piston 204 that function as sealing means to fully or partially obstruct the flow of air therethrough as will be described below. More specifically, each plug is located in the piston channel between a respective end 206, 208 of extrusion 202 and an opposed end of piston 204.

With reference to FIG. 7, each channel plug 212 comprises an air release channel 224 that runs through its complete length and a cylindrical vertical slot 226 which runs perpendicular to and intersects air release channel 224. Slot 226 is shaped to receive a valve means in the nature of a plug pin 228. When plug pin 228 is inserted into slot 226 of channel plug 212, air release channel 224 of the channel plug can be fully closed or fully opened to adjustably control the flow of air therethrough.

Plug pin 228 is formed with a pin channel 230 that runs through its width. The bottom of plug pin 228 includes an adjustment slot 232, which allows the plug pin to be turned. As seen most clearly in FIG. 3, two plug pin location holes 234, 236 are drilled vertically into the bottom of support track extrusion 202 such that the location holes extend from the bottom surface of the support track extrusion to open into piston channel 210. The first location hole 236 is drilled proximate to the first end 206 of the support track extrusion and the second location hole 234 is drilled proximate to the second end 208 of the support track extrusion. The actual locations of holes 234 and 236 will be determined with respect to the width of door 300 and the distance it travels side to side between its fully opened and fully closed positions. This allows the use of one length for piston rod 204 for most if not all door sizes.

Each channel plug 212 is slid into location in piston channel 210 with respective slots 226 aligned with respective location holes 234, 236. A plug pin 228 is inserted into each slot 226 via holes 234, 236 and the pins 228 can be rotatably adjusted with access through holes 234, 236. The plug pins are sufficiently long that when inserted into channel plugs 212, a lower portion 213 of each pin remains in a respective location hole 234, 236. This locks the channel plugs in the piston channel to prevent their movement relative to piston 204.

Each plug 212 forms an air-tight or substantially air-tight seal with piston channel 210 such that air can only pass the plugs through air release channels 224. The amount of air can be controlled by turning plug pins 228 to align or misalign channels 230 with channels 224. Sealing between each plug 212 and channel 210 is provided by any suitable means such as ring seals 213.

Figures 3, 4:
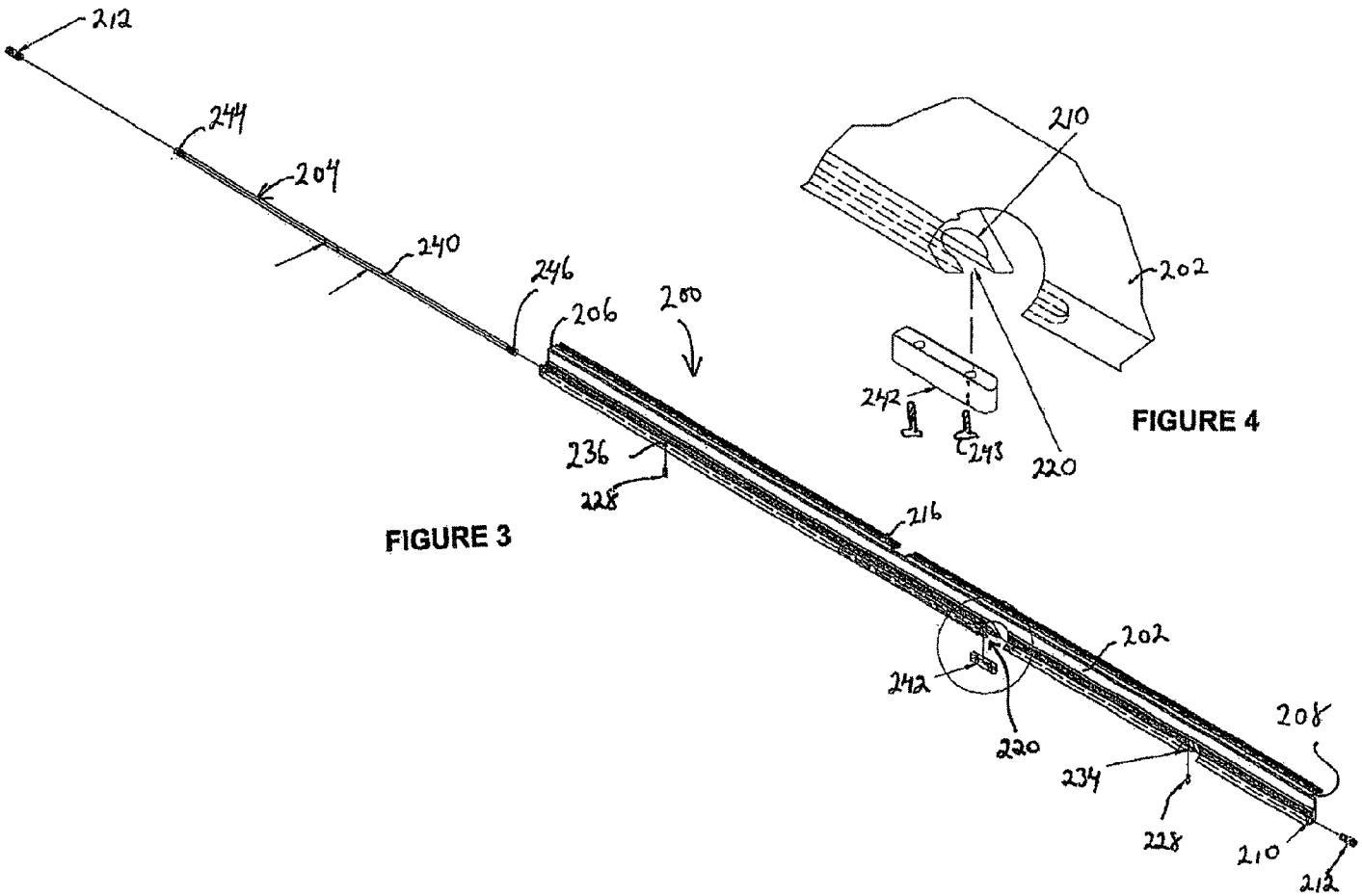
FIG. 3 is an exploded view of a support track assembly of the sliding door assembly.
FIG. 4 is a perspective partially sectional view of the piston channel component of the sliding door assembly.

Piston 204 itself comprises a rod 240, stop block 242 and two plungers 244, 246 at the rod's opposite ends. Stop block 242 is attached at the midpoint of the rod's length as best shown in FIG. 4 such as by means of screws 243 or adhesives. The length of the piston is less than the distance between the two channels plugs 212, situated in piston channel 210.

Piston 204 sits slidably in piston channel 210 of support track extrusion 202 between the two channel plugs 212. Sealing means such as plungers 244, 246 on either end of rod 240 form air-tight or substantially air-tight seals between the rod and piston channel 210 using, for example, ring seals 245. Stop block 242 connected to the piston is located in cut-out 220 in extrusion 202 and is tall enough to extend below the bottom surface of support track extrusion 202 where it can be engaged by contact members such as bumpers 500, 502 installed on door 300 as will be described below to move the stop block and the attached piston from side to side as the door is opened and closed.

There may be applications in which damping or braking of the door's movement in one direction only is required, in which case, only one plug 212 installed on the appropriate side of piston 204 can be used.

Mounting arm 216 is a substantially horizontal flange-like extension of support track extrusion 202 which extends longitudinally from adjacent the first end 206 of the support extrusion to adjacent the second end 208 and is shaped to connect with an existing wall structure. More specifically, the outer edge 217 of arm 216 is shaped to releasably engage horizontal stringer 602 that cases the upper edge of the door frame. This connection will be described in more detail below.

Referring again to FIG. 2, support track 202 is formed with a roller channel 218 which is a generally U-shaped longitudinal channel in support track extrusion 202 which extends from first end 206 of the support track extrusion to the second end 208. The roller channel has indented grooves 238 proximate to the ends of the support track extrusion 202 that stop door travel and locate the door in its fully opened and closed position when rollers 304/306 engage in respective ones of the grooves.

Door Assembly

Referring again to FIG. 1, door 300 comprises a door extrusion 302 which is essentially the door's frame, a door panel 304 which typically will be glass, wood or metal, two or more roller bearings 304, 306 extending rearwardly from the upper horizontal stile 307 of frame 302, and a roller guide channel 310 located on the lower edge of the frames lower stile.

Figure 6:
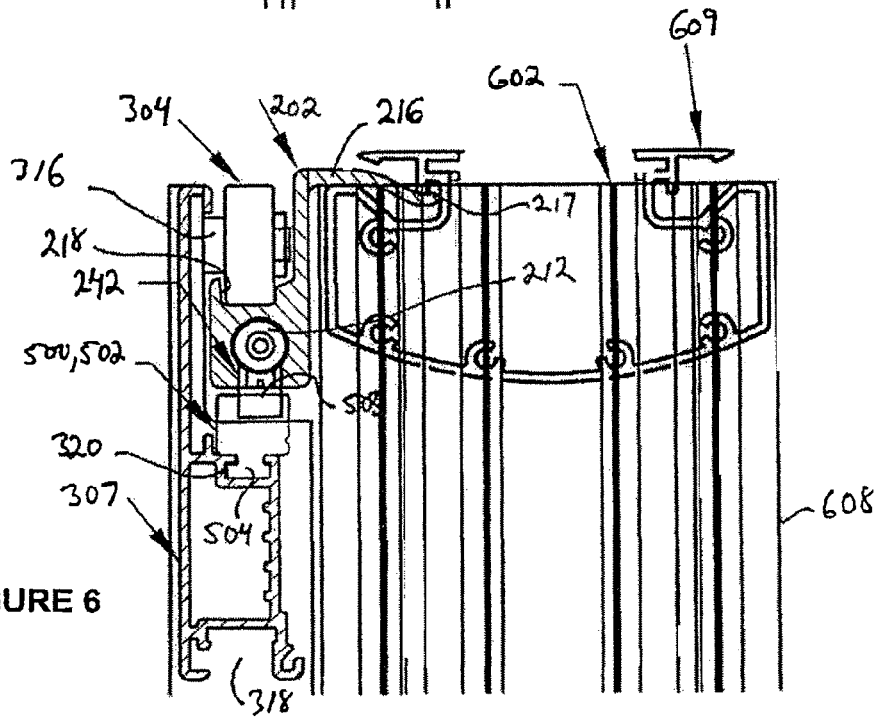
FIG. 6 is a side elevational partially sectional view of the sliding door assembly.

Upper stile 307 of door extrusion 302 comprises a first end 312, a second end 314, and as seen most easily in FIG. 6, roller bearing supports 316, a glazing channel 318 and a T-shaped slot 320 for bumper plugs 500 and 502. As mentioned above, bumper plug slot 320 is essentially a T-shaped channel that extends longitudinally from end 312 to end 314 of upper door stile 307. Bumper plugs 500 and 502 are themselves elongated blocks made preferably of a resilient and durable material, such as rubber or PVC, and having a T-shaped portion 504 that slidably engages the correspondingly shaped slot 320.

Figure 9:
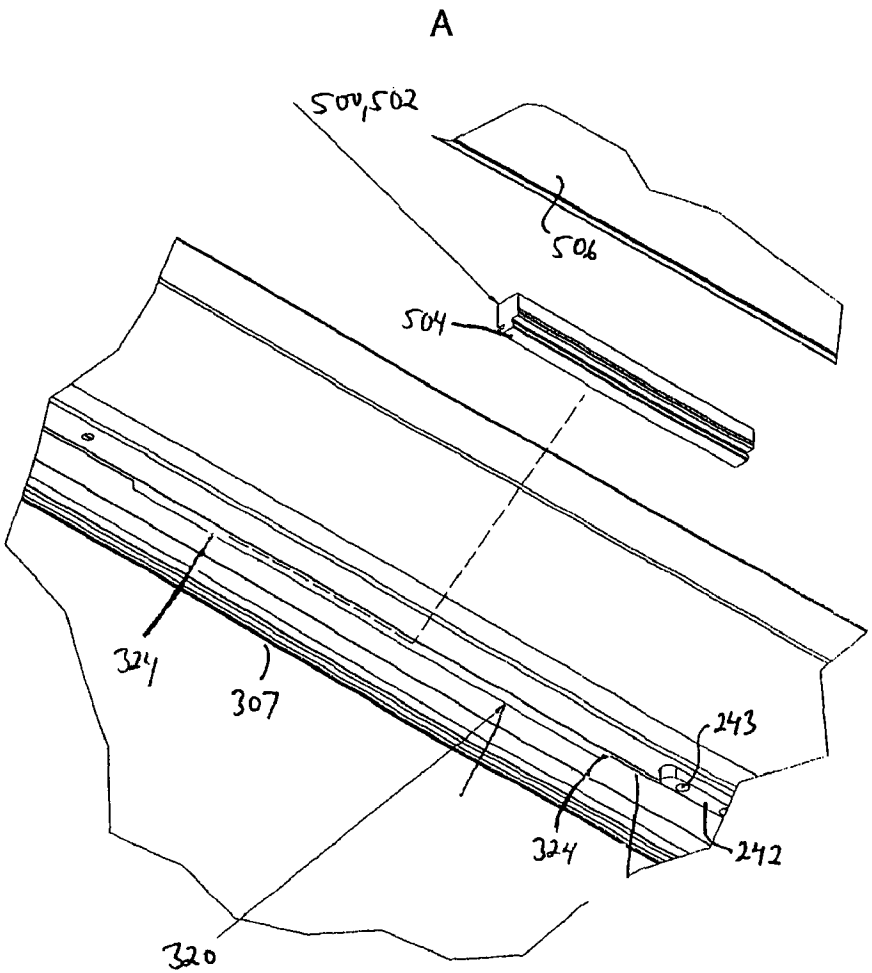
FIG. 9 is an enlarged perspective, partially cutaway and exploded view of the door assembly of FIG. 8.
Figure 8:
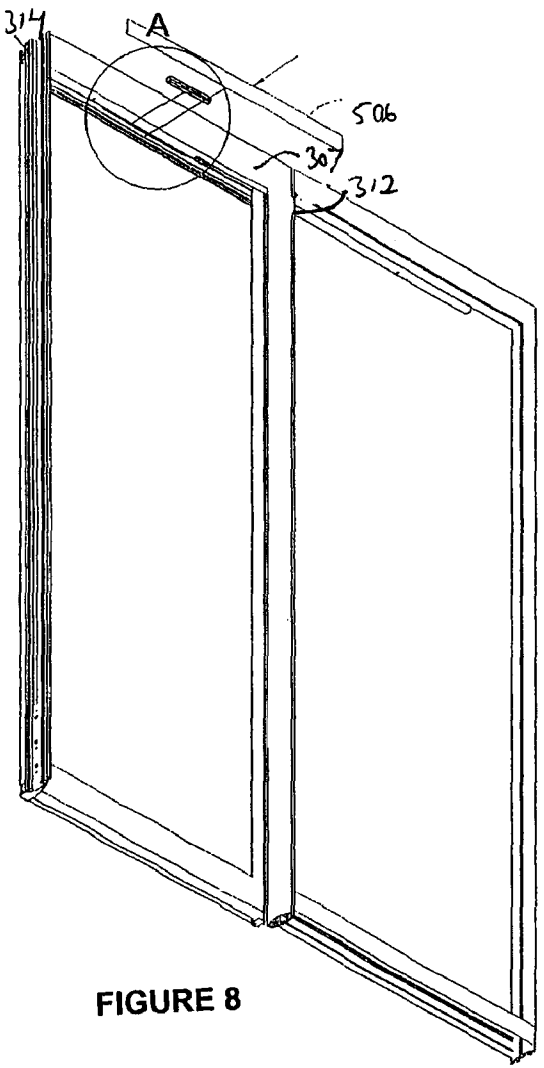
FIG. 8 is a rear lower perspective view of the sliding door assembly of FIG. 1.

Reference will now be made to FIGS. 6, 8 and 9 to describe bumper plugs 500, 502 and their installation on upper door stile 307. Halfway between the ends 312, 314 of the stile, there is a cut-out 324 in one side of slot 320 that allows bumper plugs 500 and 502 to be inserted into slot 320 and then slid respectively right and left in the slot towards ends 312 and 314.

Roller bearings 304, 306 comprise any quiet running rollers that roll back and forth in roller channel 218 of support track extrusion 202 and essentially suspend the door from extrusion 202. When the door is mounted in this way, and as seen most clearly in FIG. 6, the upper surfaces 503 of the bumper plugs are in close proximity to the lower surface of extrusion 202 which prevents the door from being lifted vertically off extrusion 202.

At the bottom of door 300, roller guide channel 310 comprises an extrusion as long as the width of door 300 and is in the shape of an inverted U-shaped channel. This channel is used to engage floor mounted guide rollers 402, one of which is shown in FIG. 10, that prevent the door from swinging away from the door frame.

A description of the installation process for a sliding door assembly according to an embodiment of the present invention follows.

Figure 12:
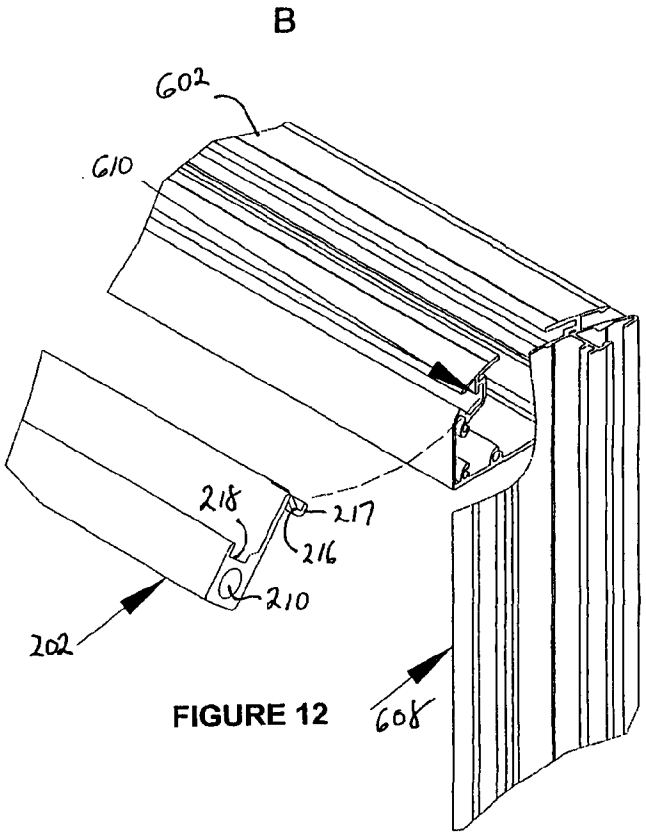
FIG. 12 is an enlarged perspective view of a portion of FIG. 11.
Figure 11:
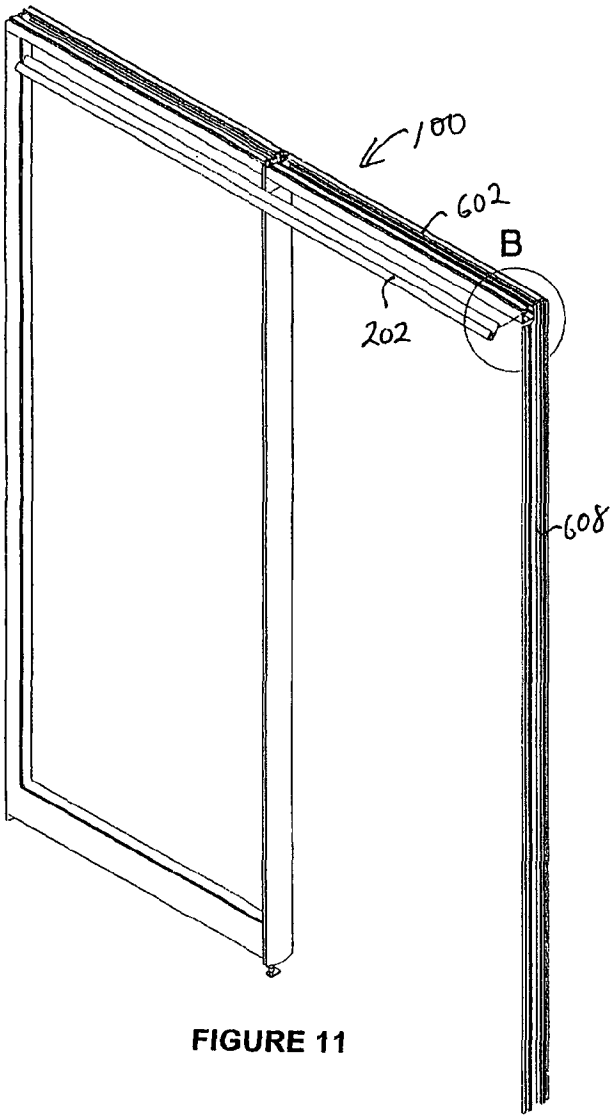
FIG. 11 is a front perspective view of the door assembly showing installation of the support track assembly of FIG. 3.

Referring now to FIGS. 11 and 12, the sliding door assembly 100 is installed to cover an existing opening in a wall or similar structure in the following steps. The opening itself might typically be a rough stud opening for a patio or barn door or virtually any application that can usefully be covered by the present door assembly.

The upper edge of the opening is pre-finished with one or more horizontal stringers 602. The sides of the opening are pre-finished with vertical stringers 608. As shown most clearly in FIG. 6, the stringers can include flats 609 useful to receive fasteners for connecting the stringers to the surrounding framework of studs, headers or other structural members that make up the opening.

Outer edge 217 of mounting arm 216 on support track extrusion 202 hooks into a channel 610 in stringer 602 and the extrusion is then rotated downwardly into the locked cantilevered position most clearly visible in FIG. 6. Stringer 602 represents merely one type of construction; support track assembly 200 can be attached to any upper wall structure comprising a channel that can receive the mounting arm of the support track assembly, or arm 216 can be a simple nailing or screw plate for connection to a wooden header using standard screws or nails.

Roller guide or guides 402 are attached to the floor generally beneath door 300 such that when the door is in its final position, roller guide channel 310, at the bottom of door assembly 300, will engage roller guide 402.

Next, door assembly 300 is mounted on support track assembly 200 by first setting guide channel 310 on the bottom of the door assembly onto roller guides 402, and then raising door assembly 300 and manoeuvring roller bearings 304, 306 into roller channel 218 of support track extrusion 202.

Figure 13:
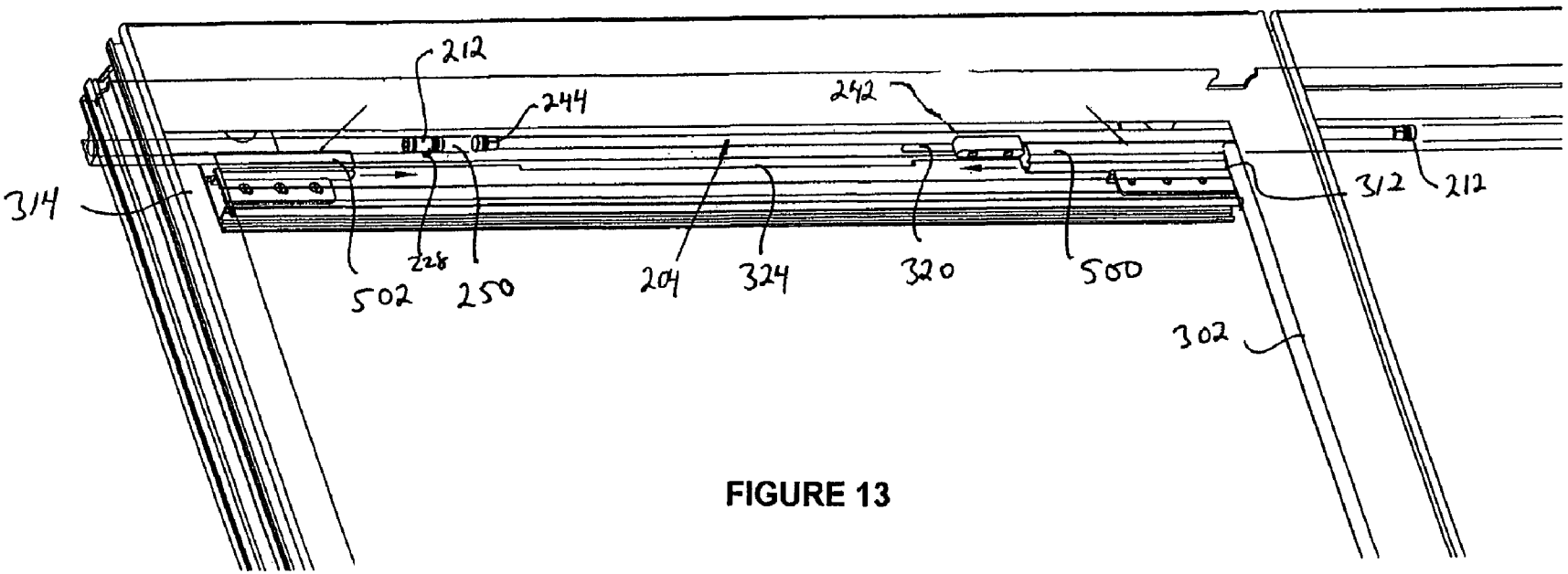
FIG. 13 is a rear perspective view of the door assembly of FIG. 1 showing the operation of the assembly.

As seen most clearly in FIG. 13, one bumper plug 500 is inserted through cut-out 324 into slot 320 and pushed towards the first end 312 of door extrusion 302, stopping at the end of the slot which is closed by door frame 302. The second bumper plug is then similarly inserted through cut-out 324 into slot 320 and pushed towards the second end 314 of door extrusion 302, stopping at the door frame. After the bumper plugs are in place, a cover plate 506 is optionally attached over cut-out 324 for improved aesthetics.

Once installation is complete, door assembly 300, supported by roller bearings 304, 306 disposed in roller channel 218, can be moved back and forth in a plane parallel to and spaced from the wall in which the door assembly is located.

A description of the braking mechanism for sliding door assembly 100 according to an embodiment of the present invention follows.

When the sliding door assembly has been fully assembled, the braking mechanism of the sliding door assembly operates to slow the sliding motion of the door as it approaches its fully opened and closed positions.

Referring now to FIG. 13 again, when door assembly 300 is moved to the left, bumper plug 500 will contact stop block 242. The distance the door will move before the bumper contacts stop block 242 can be varied by using bumpers of different lengths. There are other means of accomplishing the same thing that will occur to those skilled in the art. For example, the bumpers can be located and fixed in slot 320 at positions closer to or further from the stop block. If the door assembly continues to move left, bumper plug 500 will continue to move left and will push stop block 242 left in front of it. Stop block 242 is attached to the center of piston 204. When stop block 242 is pushed left, piston 204 is also pushed left. As piston 204 is pushed left, air 250 in piston channel 210 between plunger 244 on the left end of piston rod 240 and the right side of channel plug 212 is compressed. Only a small amount of air can escape through air release channel 224 in channel plug 212 and pin channel 230 in the pin plug. The compressed air 250 provides resistance to the continued movement of door assembly 300 to the left. The further and faster door assembly 300 is moved, the greater the resistance to said movement due to air compression. The level of resistance can also be adjusted by turning plug pin 228 to alter the alignment of pin channel 230. An alignment of air release channel 224 of channel plug 222 and pin channel 230 of pin plug 228 provides maximum air escape and minimizes air compression. A misalignment of the channels provides less or no air escape. Groove 238 at the left end of roller channel 218 will engage roller bearing 306 of door extrusion 302 when the door 300 reaches its final open or closed position. The above process is repeated as the door is moved back to the right.

In the event the door is forced or slammed with sufficient force to overcome the resistance of compressed air 250, stop block 242 will compress one of bumper plugs 500, 502 to absorb the excess energy.

Ideally, the length of cut-out 324 will at least slightly exceed that which is necessary to fully accommodate the travel of door 300 as shown in FIG. 13. In this way, stop block 242 cannot be forced against the very end of the cut-out which could otherwise cause damage or even failure to the mechanism if sufficient force is applied. Obviously however, bumper plugs 500 and 502 themselves must be cut to the right length to avoid pushing the stop block against the very end of cut-out 324. The length of cut-out 324, the length of bumper plugs 500 and 502 and the location of plug pins 212 will be easily determined by the skilled technician based on the size of the door assembly and the distance door 300 will be required to travel from side to side.

The present apparatus has been described for use to damp the motion of a sliding door but the person skilled in the art will appreciate that it can be adapted to damp the movement of other moveable objects as well including for example track mounted containers, filing cabinets and the like that are movable from side to side to more efficiently use available room space.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A sliding door apparatus for an opening in a wall, comprising:

a track assembly mountable along an upper edge of said opening, said track assembly having a track member, said track member including a guide channel therein and a generally cylindrical channel therein, wherein said guide channel extends along a longitudinal axis of said track member, a length of said guide channel is substantially equal to a length of said track member and said track member is a one-piece integral element;

a door including at least one guide structure which engages said guide channel of said track member to partially support the weight of the door as said guide channel guides sliding movement of said door between opened and closed positions; and a damping mechanism disposed within said generally cylindrical channel of said track member and actuatable in response to said sliding movement of said door to brake said of said door movement as said door approaches said opened and closed positions, said damping mechanism comprising a member moveable within said generally cylindrical channel along a longitudinal axis of said generally cylindrical channel, wherein said longitudinal axis of said generally cylindrical channel is parallel to said longitudinal axis of said track member;

a first seal creating a substantially air-tight seal between said moveable member and said generally cylindrical channel;

a second seal fixed at a predetermined position within said generally cylindrical channel on one side of said moveable member, said second seal creating one of a fully and partially air-tight seal with said generally cylindrical channel; and an actuating member operably connected to said moveable member and transmitting said sliding movement of said door to said moveable member, such that when said moveable member is moved towards said second seal within said generally cylindrical channel in response to said sliding movement of said door, air between said moveable member and said second seal is compressed to progressively resist the sliding movement of said door.

2. The apparatus of claim 1 wherein said second seal is a plug member fixedly located in said generally cylindrical channel, said plug member having an aperture formed therein for allowing a predetermined flow rate of air therethrough.

3. The apparatus of claim 2 wherein said flow rate of air through said plug member is adjustable for varying the resistance to said sliding movement of said door.

4. The apparatus of claim 3 wherein said actuating member is a block connected to said moveable member, said block extending through said track member for selective contact with said door to transmit said sliding movement of said door to said moveable member.

5. The apparatus of claim 4 wherein said moveable member is a piston.

6. The apparatus of claim 5 wherein said piston comprises a rod axially aligned within said generally cylindrical channel, said first seal comprising seals located on an end of said rod opposed to said plug member.

7. The apparatus of claim 6 wherein a second plug member is located in said generally cylindrical channel, said rod including seals on another end of said rod opposed to said second plug member.

8. The apparatus of claim 7 including at least one contact member located on said door for pushing said block and said piston connected thereto towards a respective one of said plug members.

9. The apparatus of claim 8 wherein said contact member is located on said door at a position such that said door can be moved a selected distance before said contact member contacts and moves said block and said piston connected thereto towards said respective one of said plug members.

10. The apparatus of claim 9 wherein said contact member is a bumper comprising a compressively resilient material.

11. The apparatus of claim 10 wherein said guide structure includes rollers connected to said door adjacent an upper edge of said door, said guide channel receiving said rollers therein to suspend said door from said track member and to guide said sliding movement of said door.

12. The apparatus of claim 10 wherein said track assembly includes a flange extending from said track member and said flange is shaped to hook into a structural member for connecting said track member to said wall.

13. The apparatus of claim 12 wherein said structural member includes a channel formed therein for connectably receiving said flange thereinto.

14. The apparatus of claim 13 wherein said door includes an inverted U-shaped channel disposed on a lower edge thereof, said U-shaped channel being adapted to engage a guide member to guide said sliding movement of said door.

15. The apparatus of claim 1 wherein said second seal includes an adjustable valve therein for controlling a rate air is allowed to flow through said second seal.

* * * * *